US007896012B1

(12) United States Patent
Lee et al.

(10) Patent No.: US 7,896,012 B1
(45) Date of Patent: Mar. 1, 2011

(54) SHOE WASHER

(76) Inventors: Sang M. Lee, San Jose, CA (US); Chulhoon Kim, San Jose, CA (US)

( * ) Notice: Subject to any disclaimer, the term of this patent is extended or adjusted under 35 U.S.C. 154(b) by 273 days.

(21) Appl. No.: 12/129,528

(22) Filed: May 29, 2008

(51) Int. Cl.
*B08B 3/04* (2006.01)

(52) U.S. Cl. ..... 134/137

(58) Field of Classification Search ..... 134/137
See application file for complete search history.

(56) References Cited

U.S. PATENT DOCUMENTS 4,435,964 A 3/1984 Misawa
5,365,675 A * 11/1994 Shabram, Jr. ..... 34/109
5,418,996 A 5/1995 Chen
5,941,259 A 8/1999 Cleveland
6,735,807 B2 5/2004 Brent
2003/0196285 A1 10/2003 O

* cited by examiner

*Primary Examiner* — Michael Cleveland
*Assistant Examiner* — Samuel A Waldbaum
(74) *Attorney, Agent, or Firm* — Schneck & Schneck

(57) ABSTRACT

A shoe washing device including a motor for driving a rotor onto which the shoes are directly mounted as by aligning the soles of the shoes parallel to the axis of rotation of the rotor. The shoes are affixed onto the rotor by using a clip, strap, cage, or other attachment means. The shoes are then rotated within the wash compartment into which a wash fluid is introduced in a wash cycle and removed following a wash cycle. An integrated drying component may allow air drying of the shoes during a final spin cycle.

20 Claims, 6 Drawing Sheets

SHOE WASHER

TECHNICAL FIELD

The present embodiments relate generally to mechanical devices for washing items and more specifically to a shoe washing device.

BACKGROUND

Shoes can frequently get dirty and require cleaning. However, shoes may prove difficult to clean and commonly require an alternative method to cleaning and drying than may be used with other articles of clothing. At present, the most common method of cleaning shoes is by hand. This is laborious and may result in ineffective cleaning of shoes. Alternatively shows may be washed in a washing machine. Given that shoes may damage other garments the shoes may need to be washed separately. Even if this is the case, the shoes may create an unbalanced load within a rotating wash drum, creating additional wear and tear to the drum, linkages, belts, and motor components. In addition, washing machines are not designed for washing shoes and may be ineffective in cleaning shoes. There is also wear and tear on the shoes due to collision with the metal tub wall of the machine, some consumers prefer a separate device for washing shoes so as to not damage or contaminate other more delicate clothing.

Ideally a separate device would be used for washing shoes. However to date the designs of separate shoe washers have been rather bulky and impractical.

It is an object of the various embodiments disclosed herein to provide a shoe washing device which is smaller and more practical than present devices. It is a further object to provide a shoe washing device that efficiently use energy and water.

SUMMARY OF THE INVENTION

The above and other objects have been achieved through a shoe washing device which includes a device housing, a wash compartment and a motor compartment. Within the motor compartment is a motor which is mechanically linked to a rotor shaft which extends into and across the wash compartment and is rotatably linked to the far side of the wash compartment.

Mounted directly onto this rotor is at least one set of shoe mounts on opposite sides of the rotor shaft. The fluidics component allows introduction of a wash fluid in a wash compartment and removal of fluid from the wash compartment. This device may also include a dryer component configured to allow drying of the washed items in the wash compartment.

The shoe mounts may include more than one set of shoe mounts. The shoe mounts may also be configured in some embodiments to be shoe clamps, shoe straps, shoe cages or other shoe attachment devices or attachment means. The fluidic system may include a pump configured to pump water into and out of the wash compartment. A water level sensor will be used to control the water level, to detect overflow and underflow of the water compartment. The rotor shaft may be vertical, horizontal, or angled within the wash compartment. The wash compartment should include an access for these shoes. This may be simply an open top to the wash compartment or may include a hatch, hinged door, threaded lid, or other wash compartment access means. The wash compartment may include a vent in the door or hatch or in the device housing.

DETAILED DESCRIPTION

Figure 1:
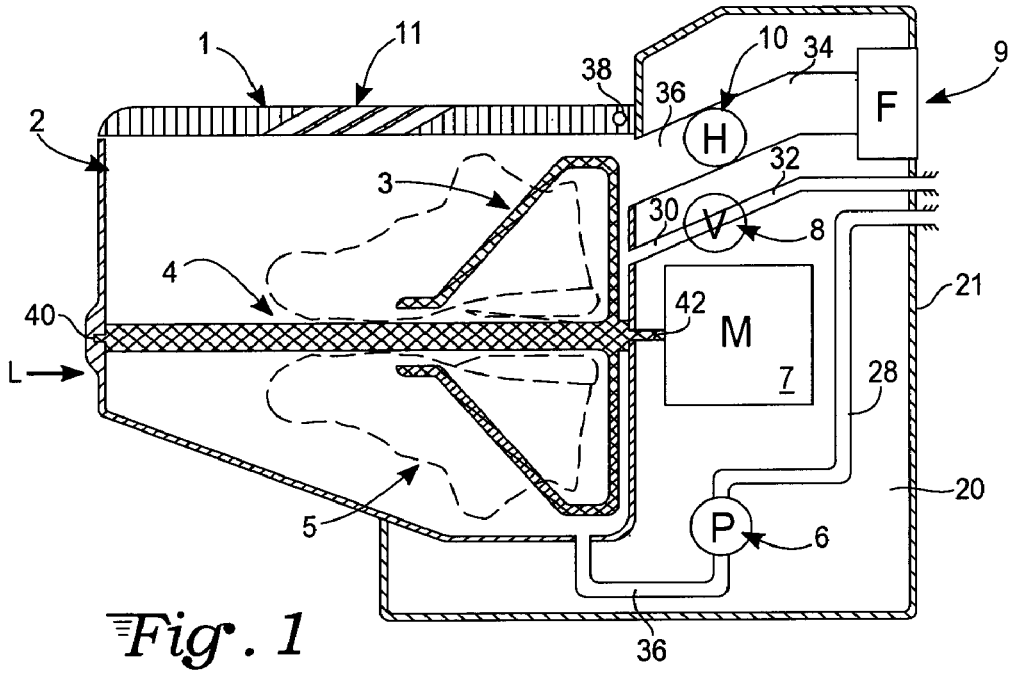
FIG. 1 is a cross-sectional view of a first embodiment of the shoe washing device.

With reference to FIG. 1, a shoe washing device is shown having a wash compartment 2 defined within device housing 21. The wash compartment 2 which may be accessed by lid 1. Lid 1 is attached to the housing 21 by hinge 38. A vent 11 on lid 1 allows air to be vented from the wash compartment 2. Within the wash compartment pair of shoes are retained on a rotor 4 by shoe attachment 3. In this embodiment shoe attachment 3 is a clip attached to rotor 4. The shoe is placed inside the shoe attachment 3 such that the sole of the shoe is pressed against rotor 4 and the sole is parallel to the axis of rotation of rotor 4.

Housing 21 of the device also encloses a motor compartment 20. A motor 7 allows rotation of rotor 4. Rotor 4 extends across the entire width of the wash compartment from a first side to an opposite side. At locations 40, 42 a ball bearing set or other rotation mounting means may be used to allow a mounting of the rotor which essentially water tight but still allows rotation of rotor 4.

Various motors are contemplated. A simple electronic motor should allow rapid rotation of the rotor 4. Various motors are considered including motors allowing rotation of the rotor up to 1200 rpm. A simple electric motor could allow rotation of rotor 4 in either direction and at varying speeds, for example, 60-120 RPM during washing and air drying, and 900-1200 RPM during the spin cycle, to provide a centrifugal force to remove water from shoes. Motor 7 may also include a braking element allowing more rapid deceleration of rotor 4. Alternatively a separate braking element may be included.

Prior to washing, a detergent may be sprayed onto shoes. Various spray cleaning products are presently available. Alternately a liquid or powder detergent may be added to the wash compartment prior to initiating a wash cycle. Shoes are soaked in and cleaned by detergent dissolved in the water. Mechanical action of collision with the water enhance the cleaning of the shoes. Introduction of a wash fluid is provided through pipe 32. This pipe 32 may be threaded at an end which projects from the outer housing of a device. A hose or other water source may then be attached to this threaded projection. Alternatively the device may be more permanently fixed to plumbing at a defined location. A water inlet valve 8 controls flow from pipe 32 into pipe 30. Pipe 30 opens into wash compartment 2. This pipe may be configured to spray the wash fluid directly onto the shoes 5 in wash compartment 2. The present configuration of the wash compartment 2 allows filling only to level L of the compartment. The shoes would be submerged in turn as rotor 4 rotates. This configuration has a number of advantages. The configuration uses a minimal amount of water, the dipping shoes in and out of the wash fluid provides an agitating force which is advantageous for removing dirt and other contaminants from the shoes, and the rotor 40 remains above the fill line. Thus, the rotor and the rotor rotation points 40, 42 do not have to be designed to function well submerged.

Figure 5:
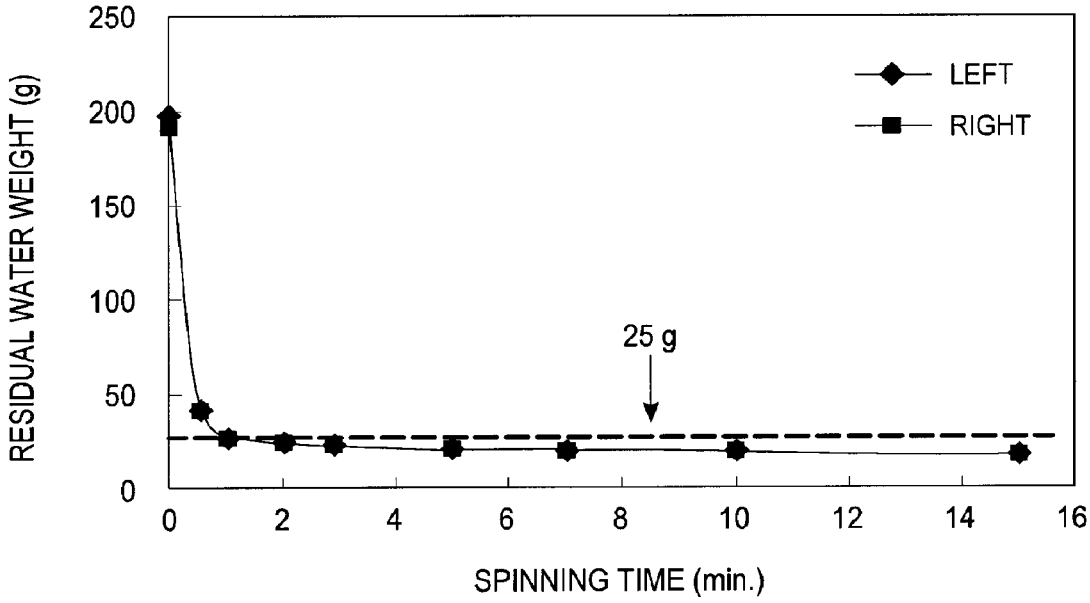
FIG. 5 is a graph of water removal by spinning.
Figure 6:
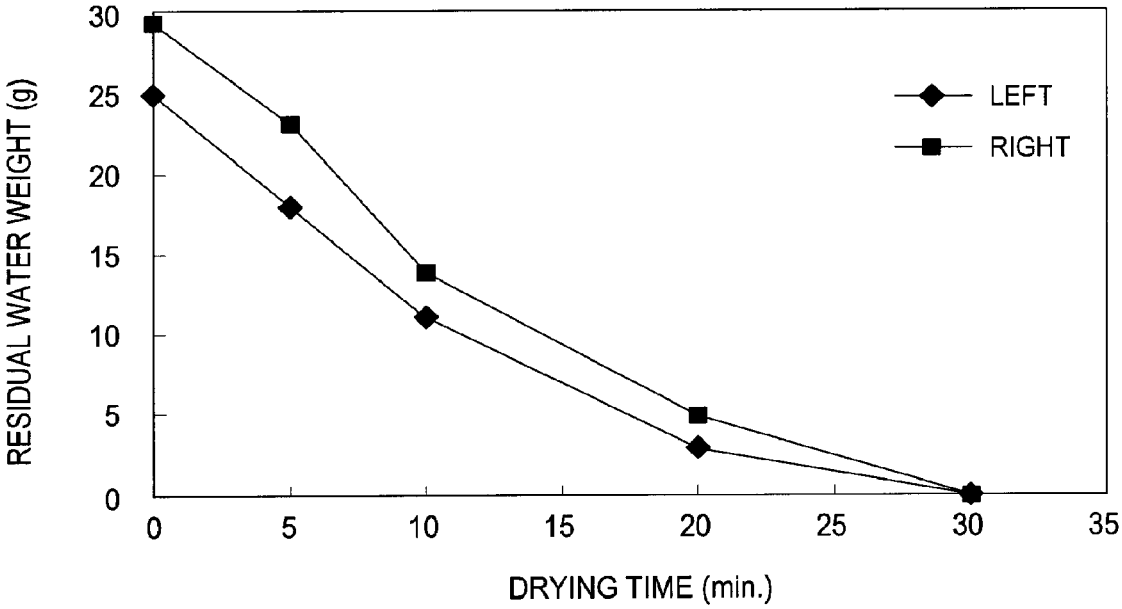
FIG. 6 is a graph of water removal by blow drying.

Following completion of a wash cycle the fluid from within the wash chamber 2 is removed through pipe 36 using pump 6 to pump water into pipe 28. An end of pipe 28 extends through housing of the motor compartment 20. The end of this pipe 28 may be threaded to allow connection to a hose which may be put into a sink or other drain location. Once the water is removed from wash tub 2 the rotor can continue to spin at a maximum speed to further remove liquid from shoes 5. After an interval of such rotation, a fan 9 is activated that draws air from outside the shoe washing device and introduces into duct 34. Duct 34 directs the blown heat past a heater 10 which warms the air. The warmed air passes into duct 36 and into the washing compartment 2. The vented air may then be blown past the rotating shoes and escape the washing compartment through a vent 11 in the housing of the wash compartment taking moisture out of shoes. Vent 11 is shown on the lid or hatch of the compartment but may be in side of wash compartment 2 above the water fill line but not on the lid of the device. As shown in the graph of FIG. 5, 2 minutes of spinning at 1200 RPM is sufficient to reach a steady weight of wet shoes, with about 25 grams of residual water weight in one cycle uses heated air and a shower spin to remove the remaining liquid from the shoes. The residual water during drying decreases almost linearly with drying time. In one process, shoes were completely dry in 30 minutes. This is shown in the graph of FIG. 6.

Figure 2:
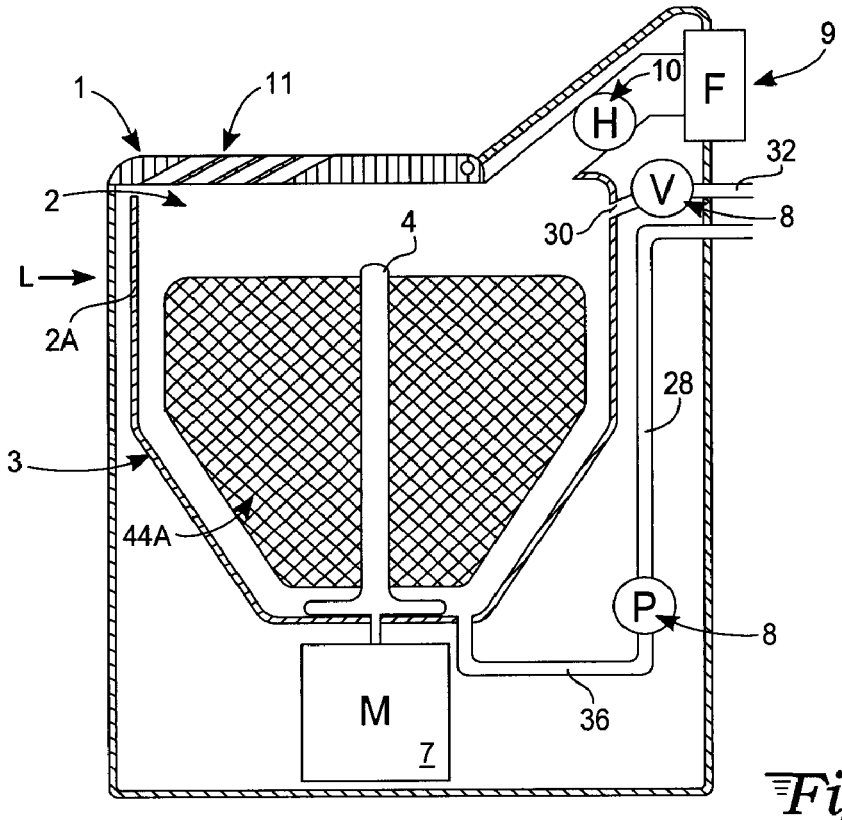
FIG. 2 is a cross-sectional view of a second embodiment of the shoe washing device.

An alternative configuration is shown in FIG. 2. As in FIG. 1, a motor shown rotates a rotor 4. Wash fluid is introduced through pipe 32 and into pipe 30 as regulated by valve 8. The wash fluid is removed through drain pipe 26 using pump 6 to drive waste into pipe 28. A fan 9 and heater 10 connected by ducts allow a drying airflow to be directed into the wash. In the second embodiment the rotor 4 is vertical and has shoe cage 44 present to attach the shoes to rotor 4. The wash compartment 2 is defined by wash compartment walls to 2A, held within housing 21. In this embodiment the wash fluid level L must be higher to submerge the shoes, which are both submerged at one time. The shoe cage 44A may be clipped or otherwise fastened onto rotor 4 to retain the shoes against the rotor. Access to the shoe cage is through lid 1. Vent 11 on lid 1 allows the escape of air during drying.

Figure 3:
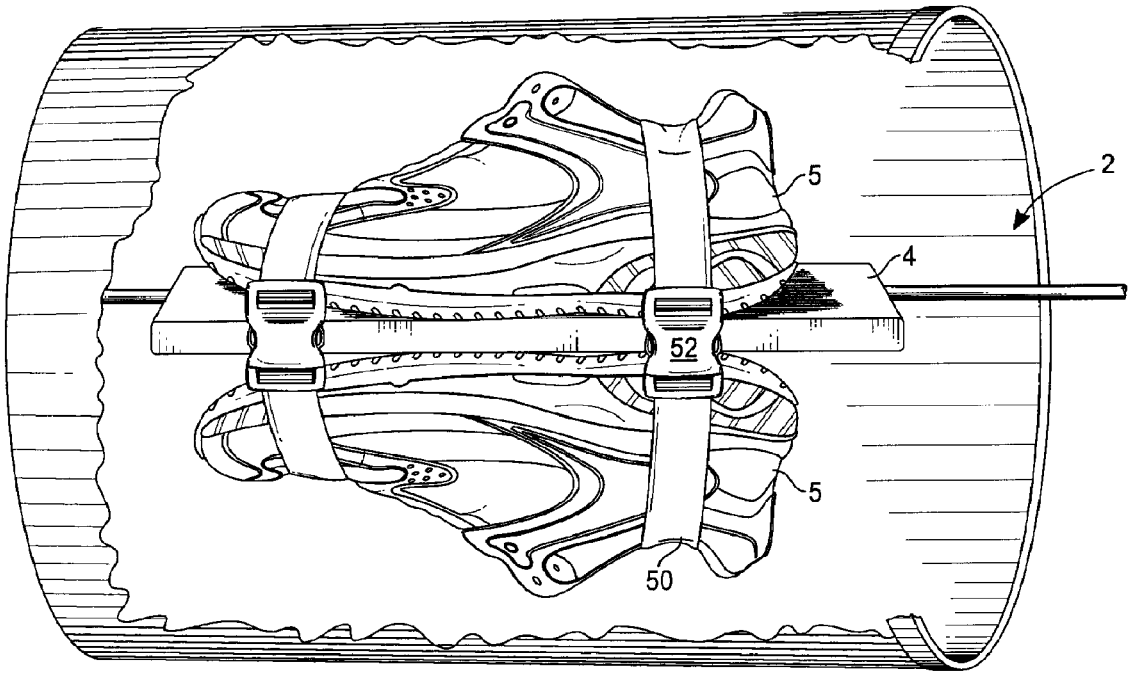
FIG. 3 is a top view of a third embodiment of a shoe washing device.

With reference to FIG. 3, in an alternative embodiment a top view is shown in which the shoes 5 are attached by straps 50 secured by clips 52 onto the rotor 4. The rotor 4 may be paddle shaped to allow one or more pairs of shoes to rest on the rotor. By expanding the length or thickness of the rotor, additional shoes may be washed at one time. The shoes are cleaned within wash compartment 2. The device may include a partially opened top or may include a hinged latch, sliding door, or other access means into the device.

Figure 4:
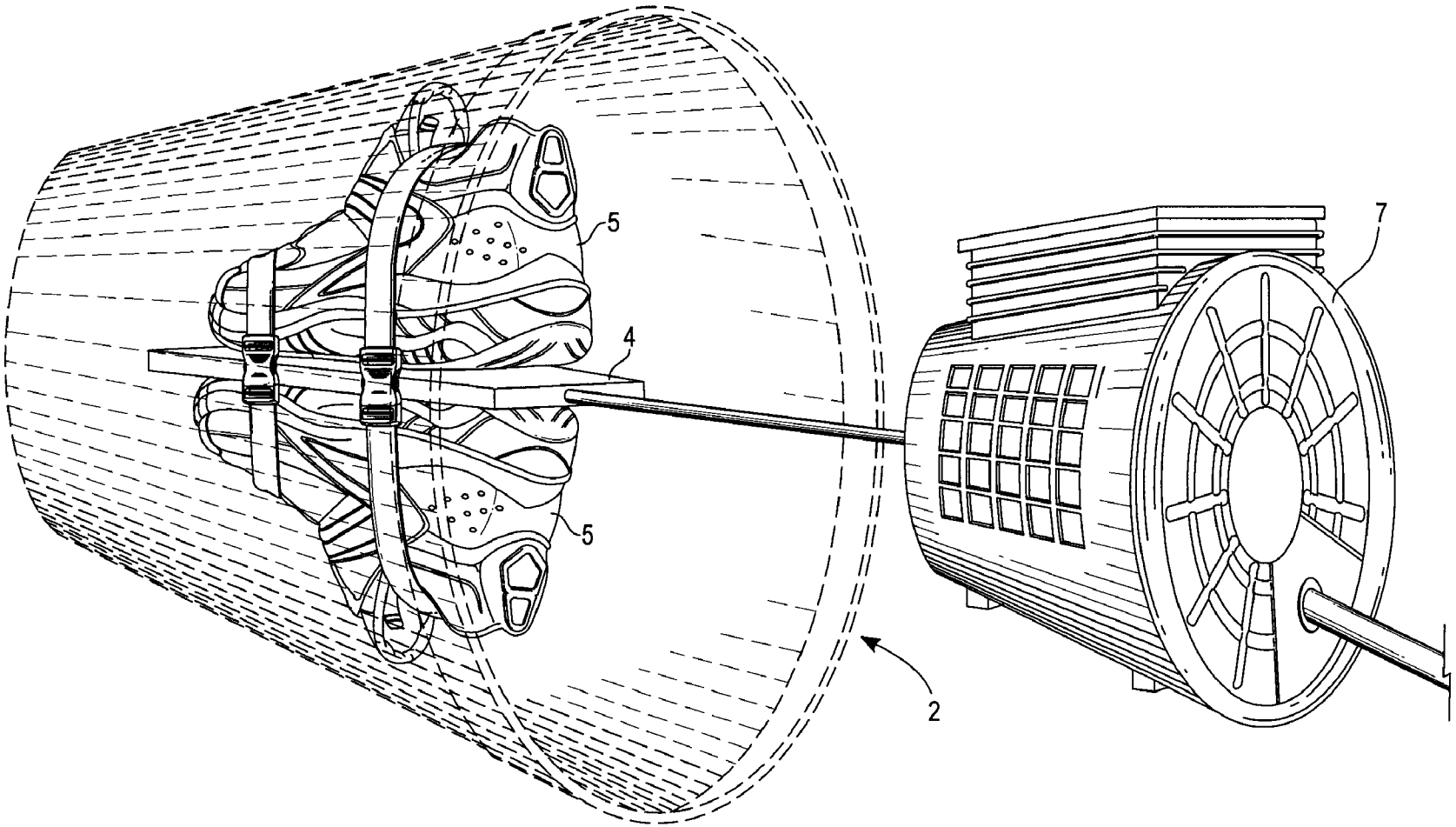
FIG. 4 is a side perspective view of the shoe washing embodiment of FIG. 3.

With reference to FIG. 4, the wash compartment 2 shown in which a motor 7 rotates the shoes 5 within a wash compartment 2. The shoes are strapped onto rotor 4.

A number of possible additions or alternatives may be used with the present invention. For example, brushes may be added to the wash chamber such that the shoes are scrubbed during rotation. A container may be used for dispensing wash detergent or bleach. Electronics may be added for the control of spinning such as a vibration monitor to ensure safety and prevent damage to the system due to unbalanced loads. The system may include tanks for dispensing a wash liquid and recovering a waste liquid to make the device self-contained.

Figure 7:
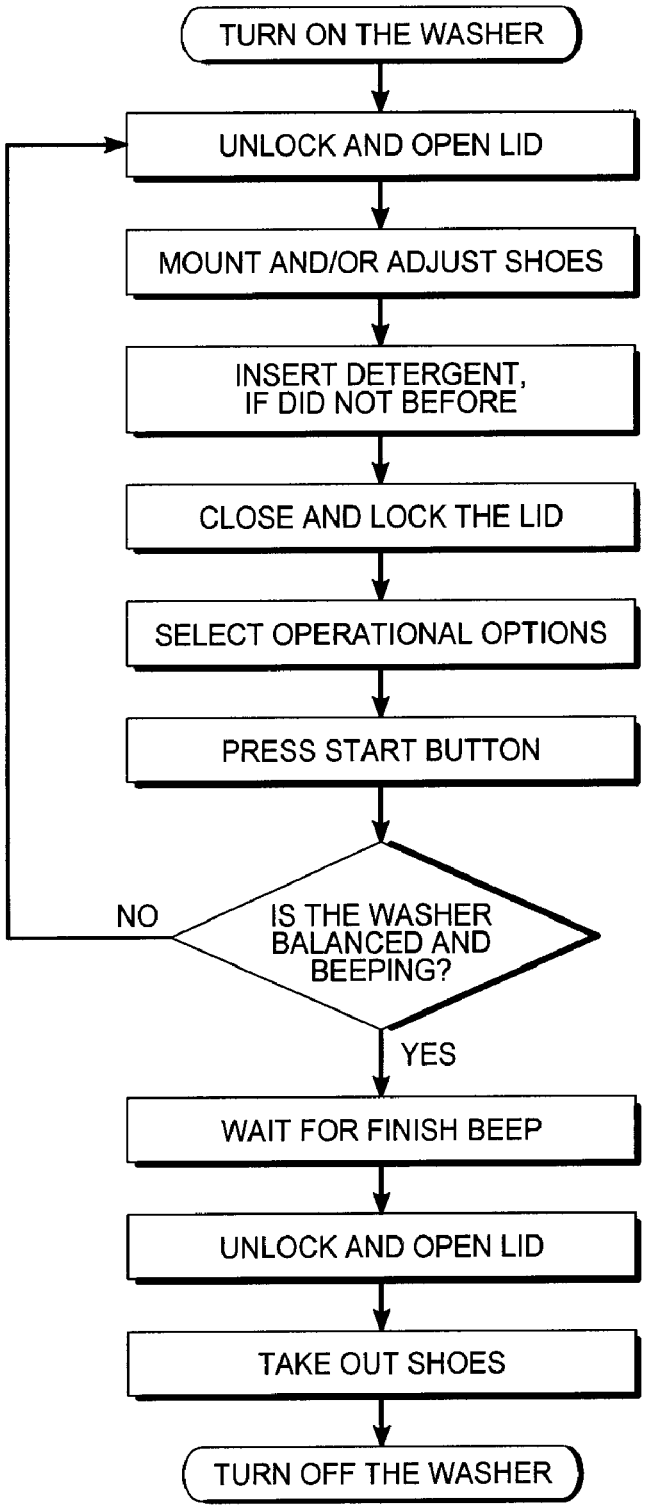
FIG. 7 is a flow chart of user steps for system operation.

FIG. 7 shows a flow chart illustrating the user operation of the system. The washer is turned on followed by unlocking and opening the lid and mounting or adjusting the shoes on the rotor. Detergent may then be added if the shoes were not sprayed prior to insertion with a detergent. The user will then close the lid which may automatically block. The user then selects operational options, such as water temperature, extended wash cycles, etc. The user then presses the start button and if the shoes are not balanced on the rotor the system will beep and the lid will unlock allowing the user to again adjust the shoes and close and lock the lid. Once the washer is balanced the wash and spin cycle will automatically take place. A audio alert will signal the end of the wash and dry cycle at which time the lid will unlock and open and the shoes may be removed. Then the washer is turned off.

Figure 8:
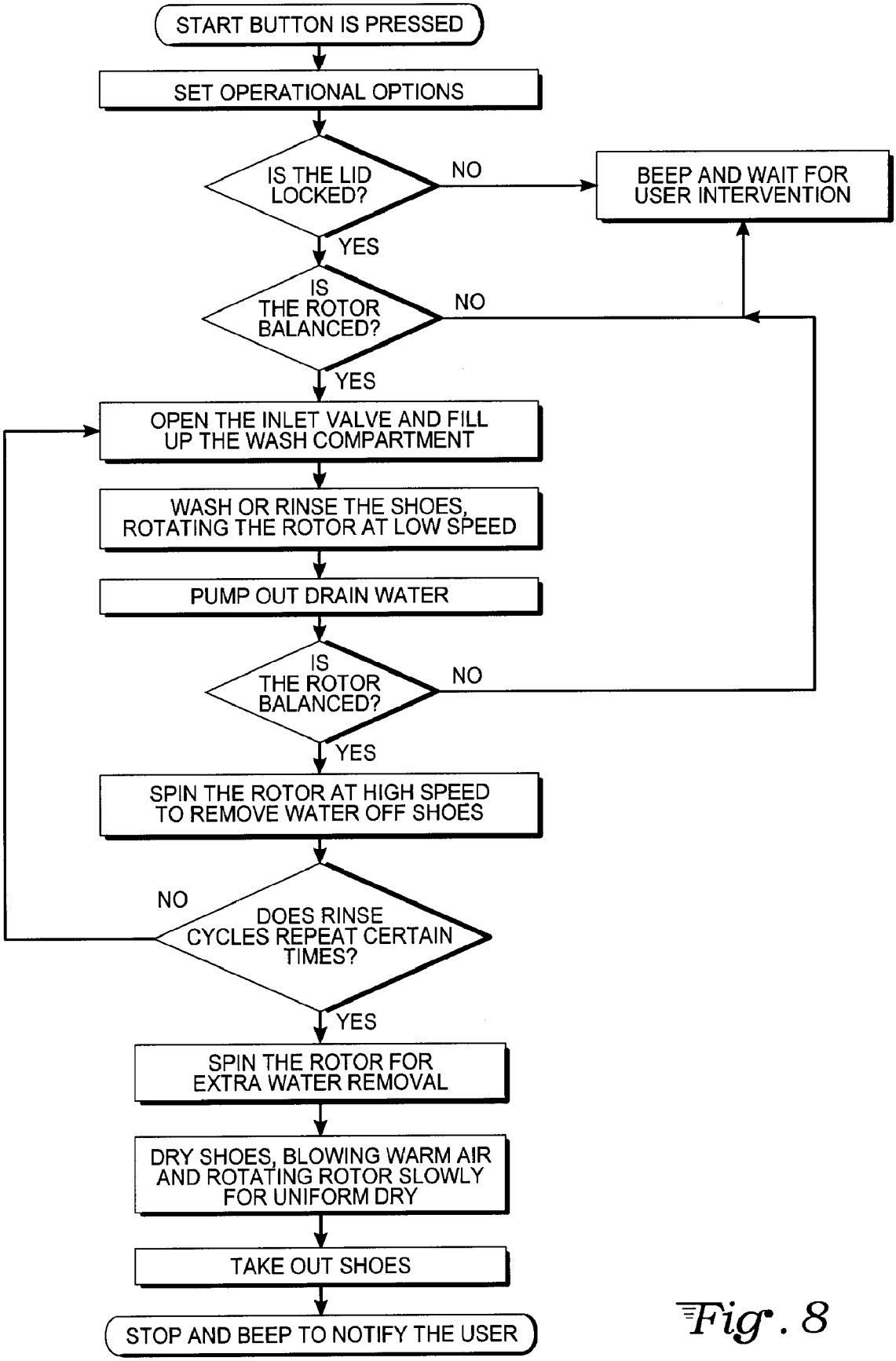
FIG. 8 is a flow chart of system steps for system operation.

With respect to FIG. 8, the system's internal operation is shown. Once the start button is pressed the system sets the operational options, such as water temperature and spin cycle lengths. If the lid does not lock automatically a sensor determines that the lid is locked, if the lid is not locked the system provides an audio alert and will stand by for a user to lock the lid. Once the lid is locked an initial tests determines if the rotor is balanced. If the rotor is not balanced again an audio alert allows user intervention. Once the rotor is balanced the inlet valve is opened allowing filling of the wash compartment. The wash cycle occurs at a low speed of the rotor followed by activation of the pump to drain fluid from the wash compartment. The system then again performs a check to ensure that the rotor is balanced prior to the high speed rotation if the load is not balanced again a audio signal requires user intervention. Once the shoes are properly balanced the high speed spin removes water from the shoes. Rinse cycles may be repeated. This is followed by a blow drying of the shoes at a lower speed to uniformly dry the shoes. Then the system would provide another audio alert to notify the user that the cycles are complete.

What is claimed is:

1. A shoe washing device comprising:

a device housing enclosing a wash compartment and a motor component compartment;

a motor contained within said drive component compartment;

a rotor shaft mechanically linked to said motor such that said motor rotates said rotor shaft; said shaft extending out of said drive component compartment and across a wash compartment such that a terminal end of said shaft is rotatably retained on a wash compartment wall;

at least one set of shoe mounts on said rotor shaft, said shoe mounts allowing a shoe to be directly, temporarily attached to the rotor shaft; and a fluidics component configured to allow introduction of a wash fluid into the wash compartment and removal of fluid from the wash compartment.

2. The shoe washing device of claim 1, further including a dryer component configured to allowing drying of washed items in the wash compartment after fluid has been removed from the wash compartment.

3. The shoe washing device of claim 1, wherein said at least one set of shoe mounts includes two sets of shoe mounts.

4. The shoe washing device of claim 1, wherein said wash compartment includes a vented hatch for allowing a user access to an interior of the wash compartment.

5. The shoe washing device of claim 1, wherein said fluidics component includes a pump configured to pump a wash fluid into a wash compartment and pump the wash fluid from the wash compartment.

6. The shoe washing device of claim 1, wherein the at least one set of shoe mounts are shoe clamps.

7. The shoe washing device of claim 1, wherein the at least one set of shoe mounts are shoe straps.

8. The shoe washing device of claim 1, wherein said rotor shaft is horizontal.

9. A shoe washing device comprising:

a wash compartment joined to the motor compartment;

a motor contained within said motor compartment;

a rotor configured to be rotated by said motor, said rotor extending across said wash compartment to an opposite side of said wash compartment;

a means for mounting shoes directly onto said rotor; and a fluidics system configured to introduce a wash fluid into said wash compartment and remove fluid from said wash compartment.

10. The shoe washing device of claim 9, wherein said rotor is configured to be vertical.

11. The shoe washing device of claim 9, wherein said rotor is configured to be horizontal.

12. The shoe washing device of claim 9, further including a dryer contained within the motor compartment and configured to dry items within aid wash compartment.

13. The shoe washing device of claim 9, wherein said wash compartment includes a device housing vent.

14. A shoe washing device comprising:

a wash compartment joined to the motor compartment;

a motor contained within said motor compartment;

a rotor configured to be rotated by said motor, said rotor extending across said wash compartment to an opposite side of said wash compartment, said rotor having an axis of rotation;

an attachment configured to mount shoes directly onto said rotor, said attachment and said rotor configured such that soles of shoes are mounted onto said rotor parallel to said axis of rotation of said rotor; and a fluidics system configured to introduce a wash fluid into said wash compartment and remove fluid from said wash compartment.

15. The shoe washing device of claim 14, further comprising:

a means for drying said shoes that includes a dryer within said motor compartment.

16. The shoe washing device of claim 14, wherein said attachment configured to mount shoes directly onto said rotor includes a shoe clip.

17. The shoe washing device of claim 14, wherein said wash compartment includes a vent that vents to an outside area that is not the motor compartment.

18. The shoe washing device of claim 14, wherein said attachment configured to mount shoes directly onto said rotor is configured to attached a plurality of pair of shoes.

19. The shoe washing device of claim 14, wherein said motor is a hydraulic motor.

20. The shoe washing device of claim 14, wherein said rotor is configured to be horizontal.

* * * * *